US008910410B2

(12) United States Patent
Peters

(10) Patent No.: US 8,910,410 B2
(45) Date of Patent: Dec. 16, 2014

(54) SLING-LESS FIREARMS CARRYING DEVICE

(71) Applicant: Shane Michael Peters, Nokesville, VA (US)

(72) Inventor: Shane Michael Peters, Nokesville, VA (US)

(73) Assignee: Tactical Solutions, LLC, Dumfries, VA (US)

( * ) Notice: Subject to any disclaimer, the term of this patent is extended or adjusted under 35 U.S.C. 154(b) by 0 days.

(21) Appl. No.: 13/830,309

(22) Filed: Mar. 14, 2013

(65) Prior Publication Data

US 2013/0276343 A1 Oct. 24, 2013

Related U.S. Application Data

(60) Provisional application No. 61/636,650, filed on Apr. 21, 2012.

(51) Int. Cl.
*F41C 33/00* (2006.01)
*A45F 5/00* (2006.01)

(52) U.S. Cl.
CPC ..... *F41C 33/006* (2013.01); *F41C 33/007* (2013.01)
USPC ..... 42/90; 224/197; 224/271

(58) Field of Classification Search
USPC ..... 42/85, 90, 97, 99; 89/1.42; 29/469; 224/193, 197, 198, 200, 243, 912, 913; D3/222, 223
See application file for complete search history.

(56) References Cited

U.S. PATENT DOCUMENTS

| | | | | |
|---|---|---|---|---|
| 476,246 | A * | 6/1892 | Burgess | 42/21 |
| 1,468,354 | A | 9/1923 | Caretto | |
| 1,497,794 | A | 6/1924 | Saunders | |
| 1,519,123 | A | 12/1924 | Morris | |
| 2,885,812 | A * | 5/1959 | Arpin | 42/85 |
| 3,708,801 | A | 1/1973 | Davis | |
| 4,243,165 | A | 1/1981 | Schuler | |
| 5,054,170 | A * | 10/1991 | Otrusina | 24/580.11 |
| 5,161,815 | A | 11/1992 | Penor, Jr. | |
| 5,528,846 | A | 6/1996 | Baggett | |
| 5,642,847 | A * | 7/1997 | DeMeo et al. | 224/623 |
| 5,669,170 | A * | 9/1997 | Norris | 42/85 |
| 5,881,487 | A * | 3/1999 | Chalker | 42/85 |
| 6,598,330 | B2 * | 7/2003 | Garrett et al. | 42/85 |
| 6,698,963 | B1 | 3/2004 | Parker et al. | |
| 6,732,466 | B2 | 5/2004 | Bentley | |

(Continued)

FOREIGN PATENT DOCUMENTS

WO WO2005079352 9/2005

OTHER PUBLICATIONS

Departments of Army, Air Force, and Navy, Army TM 9-1005-319-23&P, Nov. 2008, Departments of Army, Air Force, and Navy, pp. 1 and 0002-4 included, the entire document (436 pages) can be viewed at: http://www.kdeguns.com/ar-manual/M4%2016%02023Pchange8.pdf or will be provided upon request.*

(Continued)

*Primary Examiner* — Bret Hayes
(74) *Attorney, Agent, or Firm* — Taylor English Duma, LLP

(57) ABSTRACT

A firearms carrying device includes a receiver assembly including a base plate and a cover plate connected to the base plate; and a link arm linkable with the receiver assembly, the link arm mountable on a firearm.

20 Claims, 7 Drawing Sheets

(56) References Cited

U.S. PATENT DOCUMENTS

| | | | | |
|---|---|---|---|---|
| 6,761,294 | B2 * | 7/2004 | Gann | 224/150 |
| 7,506,470 | B2 | 3/2009 | Pereksta | |
| 2003/0075037 | A1 * | 4/2003 | Hogmoe | 89/1.42 |
| 2007/0253764 | A1 | 11/2007 | Clayton et al. | |
| 2008/0209698 | A1 * | 9/2008 | Colorado | 24/595.1 |
| 2009/0229160 | A1 | 9/2009 | Elliott et al. | |
| 2009/0288324 | A1 * | 11/2009 | Peterson et al. | 42/75.03 |
| 2009/0293334 | A1 * | 12/2009 | Swan | 42/90 |
| 2011/0083353 | A1 * | 4/2011 | Mitchell | 42/71.01 |
| 2011/0138671 | A1 * | 6/2011 | Rogers et al. | 42/85 |

OTHER PUBLICATIONS

Author Unknown, Belt Version, Date unknown, Internet image (one printed page) currently found at: http://shop.rampartcorp.com/v/vspfiles/photos/Weapon-Link-BELT-2.jpg.*

Author Unknown, FMA WeaponLink Belt Version, copyright 2012, webpage (three printed pages) currently found at: http://www.tbairsoft.com/weaponlink-belt-version-tb401-p-2561.html.*

Code 3 Tactical Supply: "Bianchi Accumold ARS Radio Holster Swivel", located at http://www.code3tactical.com/bianchiaccumoldarsradioholsterswivel.aspx; accessed on Feb. 22, 2013; 3 pgs.

Code 3 Tactical Supply: "Gould & Goodrich Radio Swivel Belt Loop", located at http://www.code3tactical.com/gould-and-goodrich-radio-swivel-belt-loop.aspx; accessed on Feb. 22, 2013, 3 pgs.

B&H Foto & Electronics Corp; Motorola Hard Leather Carrying Case; located at http://www.bhphotovideo.com/c/product/539572-REG/Motorola_RLN6302_Hard_Leather_Carrying_Case.html; accessed on Feb. 22, 2013; 6 pgs.

Code 3 Tactical Supply; "BlackHawk Law Enforcement Duty Gear Universal Radio Carrier Swivel Belt Loop" located at http://www.code3tactical.com/blackhawk-law-enforcement-duty-gear-universal-radio-carrier-swivel-belt-loop.aspx; accessed on Feb. 22, 2013; 3 pgs.

Peters, Shane; U.S. Appl. No. 61/636,650 entitled: Sling-less Firearms Carrying Device, filed Apr. 21, 2012, 37 pgs.

Maxpedition; "5" TacTie® (Pack of 4)" located at http://www.maxpedition.com/store/pc/5-TacTie-Pack-of-4-p802.htm; accessed on Mar. 10, 2013; 3 pgs.

* cited by examiner

SLING-LESS FIREARMS CARRYING DEVICE

REFERENCE TO RELATED APPLICATIONS

This application claims priority to U.S. Provisional Application No. 61/636,650, filed Apr. 21, 2012, which is hereby specifically incorporated by reference herein in its entirety.

TECHNICAL FIELD

This disclosure relates to firearms, specifically to an improved mechanism to carry firearms on one's person.

BACKGROUND

Law enforcement officers, military personnel, hunters, and competition shooters often utilize slings to carry firearms. Slings are usually composed of a series of nylon straps or other webbing material or cords with metal or plastic fastening mechanisms. Such slings passively and loosely connect the firearm to some portion about the person's body, including the shoulder/neck area, chest, back, and/or underarms. These slings suffer from a number of disadvantages. In addition, devices designed to carry portable radios using linking mechanisms are neither compatible nor suitable for carrying a firearm.

SUMMARY

Disclosed is a firearms carrying device including a receiver assembly including a base plate and a cover plate connected to the base plate; and a link arm linkable with the receiver assembly, the link arm mountable on a firearm.

Also disclosed is a firearms carrying system including a firearm; a receiver assembly including a base plate and a cover plate connected to the base plate; and a link arm linkable with the receiver assembly, the link arm mounted on the firearm.

Also disclosed is a method of using a firearms carrying device including connecting a receiver assembly to a user, the receiver assembly including a base plate connected to a cover plate; mounting a link arm to a firearm; and linking the link arm to the receiver assembly.

BRIEF DESCRIPTION OF THE DRAWINGS

The features and components of the following figures are illustrated to emphasize the general principles of the present disclosure. Corresponding features and components throughout the figures may be designated by matching reference characters for the sake of consistency and clarity.

DETAILED DESCRIPTION

Disclosed is a firearms carrying device and associated methods, systems, devices, and various apparatus. The firearms carrying device includes a receiver assembly and a link arm. It would be understood by one of skill in the art that the disclosed firearms carrying device is described in but a few exemplary embodiments among many. No particular terminology or description should be considered limiting on the disclosure or the scope of any claims issuing therefrom.

Accordingly, several advantages of the disclosed firearms carrying device may include, but are not limited to:

(a) a firearm carrying device void of any nylon or other webbing material that interferes with firearm functions;
(b) a firearm carrying device that does not impede firearm shooting positions or proper shoulder to cheek weld;
(c) a firearm carrying device that allows the shooter to quickly move the firearm into position from carry while minimizing or eliminating snagging on equipment;
(d) a firearm carrying device that reduces obstructions to equipment mounted on a belt or utility vest from the device itself;
(e) a firearm carrying device that does not block access to equipment mounted on a belt or utility vest when the firearm is in use;
(f) a firearm carrying device that decreases or eradicates neck strain and strap burns;
(g) a firearm carrying device that employs only gross motor skills with very little or no delay in shedding a firearm in the event of an emergency;
(h) a firearm carrying device that produces little or no noise;
(i) a firearm carrying device that reduces or eliminates firearm bounce in the normal carry position;
(j) a firearm carrying device for law enforcement officers and soldiers that avoids aiding an assailant who would otherwise be able control the officer or soldier utilizing aforementioned sling systems;
(k) a firearm carrying device that may be mounted on either side of the firearm's buttstock, buffer tube, or similar protrusions.

Further advantages may include a firearm carrying device which does not require a pouch for the firearm, which can mount the piece attached about the person's body in multiple ways and locations including a utility vest, belt, or torso, etcetera which makes options for different spaces between the piece attached to the firearm and the part it connects to about the person's body, and which does not require any contortion of the firearm to remove it from the piece attached about the person's body. The previously-disclosed advantages should not be considered limiting.

Figure 1:
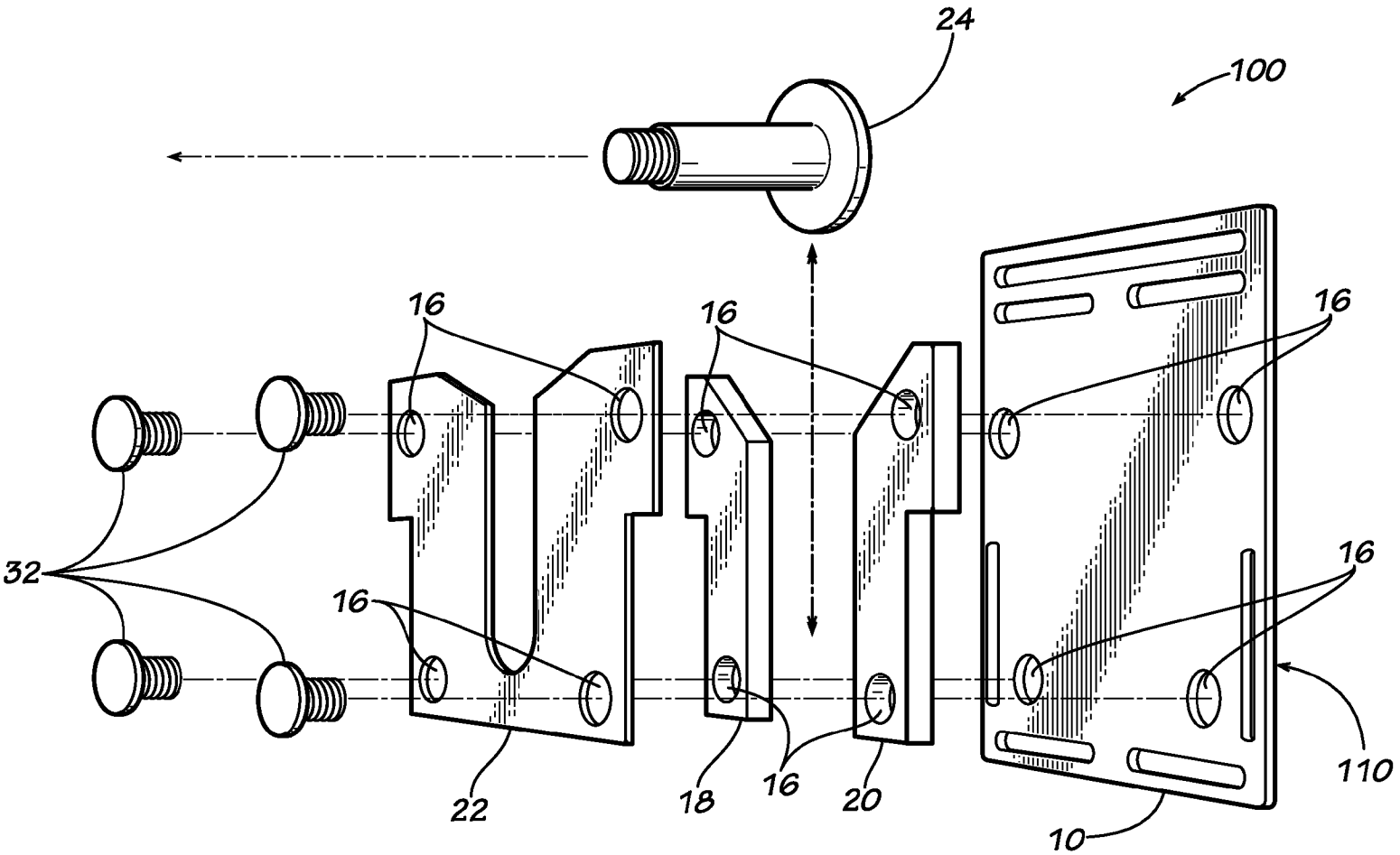
FIG. 1 is a perspective exploded view of a firearms carrying device in accord with one embodiment of the current disclosure.
Figure 3:
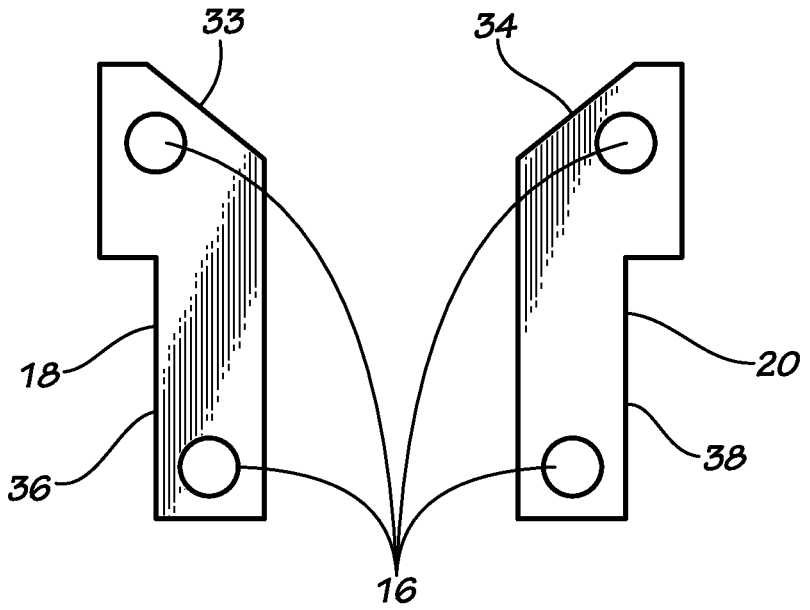
FIG. 3 is a frontal view of a pair of channel spacers of the receiver assembly of the firearms carrying device of FIG. 1.
Figure 4:
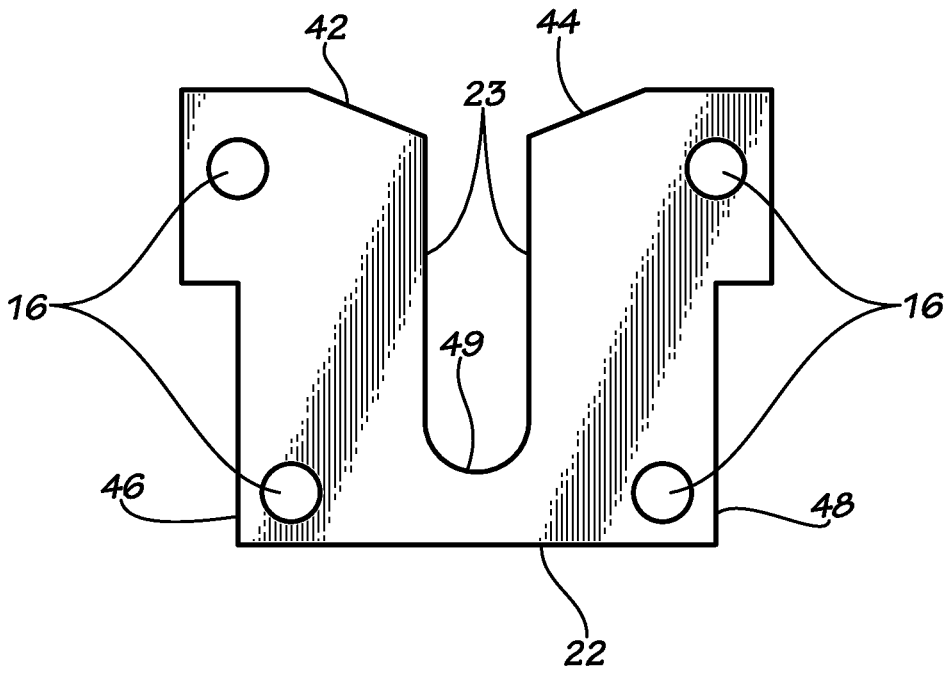
FIG. 4 is a frontal view of a cover plate of the receiver assembly of the firearms carrying device of FIG. 1.
Figure 5:
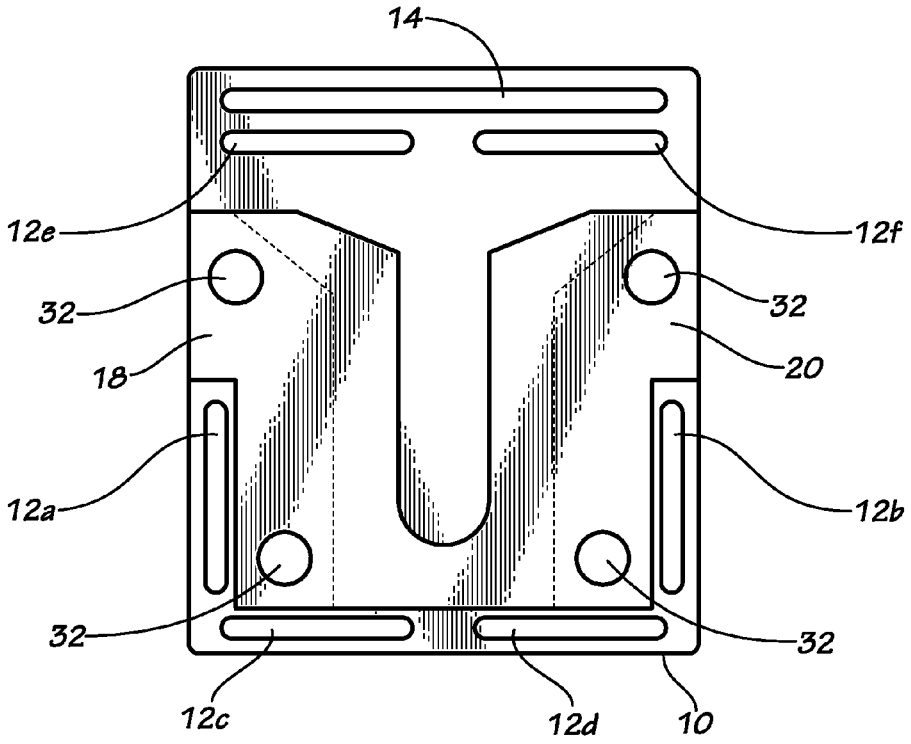
FIG. 5 is a frontal view of the receiver assembly of the firearms carrying device of FIG. 1.

One embodiment of a sling-less firearms carrying device 100 is disclosed and described in FIG. 1-7. FIG. 1 and FIG. 5 depict a receiver assembly 110 including a cover plate 22, channel spacers 18,20, a base plate 10, and a plurality of fasteners 32. The fasteners 32 connect cover plate 22 to channel spacers 18,20 and base plate 10 through a plurality of circular through-holes 16 defined in cover plate 22, channel spacers 18,20, and base plate 10. In the current embodiment, the fasteners 32 pass from the front of the cover plate 22 and through the channel spacers 18,20 to connect cover plate 22 and channel spacers 18,20 to the base plate 10. In various embodiments, the fasteners 32 could pass from the back of the base plate 10 and through the channel spacers 18,20 to connect base plate 10 and channel spacers 18,20 to the cover plate 22. In the current embodiment, the fasteners 32 are metal rivets. However, the fasteners 32 may be any permanent or removable fastening device such as blind rivets, flush rivets, sex bolts, and mating screws (aka barrel nut and binding post), chain ring bolts, screws, bolts, etc. In addition, the cover plate 22, channel spacers 18,20, and base plate 10 may be connected by any method, including glue, welding, or being formed integrally with each other. The length of the fastener shaft in the current embodiment is roughly 7.9 mm (5/16"). The approximate diameter of the fastener shaft in the current embodiment is 7.9 mm (5/16"). The approximate diameter of the fastener head in the current embodiment is 14.5 mm (9/16"). The circular through-holes 16 in the current embodiment are approximately 7.9 mm (5/16") in diameter and vary in depth according to the thickness of each piece as articulated below. However, the dimensions of the fasteners 32 should not be considered limiting and may be different in various embodiments and should not be considered limiting. FIG. 1 further depicts movement of a slide link arm 24 as it enters and exits the receiver assembly 110.

Figure 2:
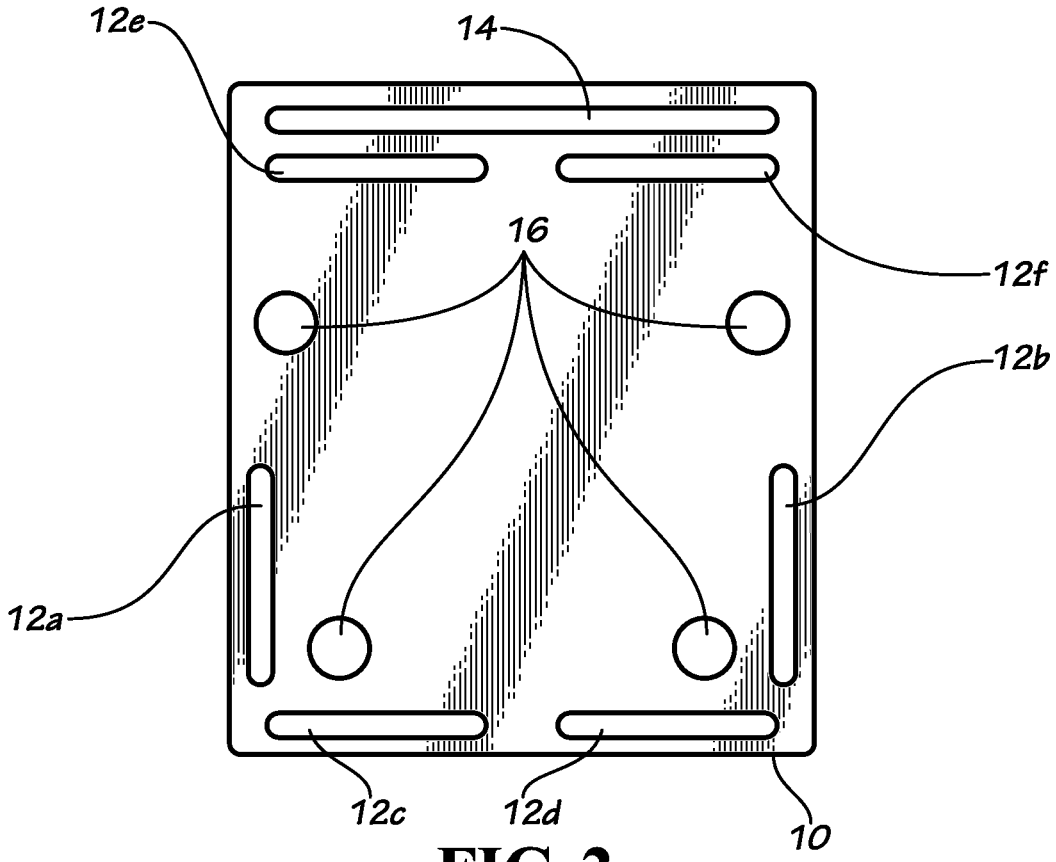
FIG. 2 is a frontal view of a base plate of a receiver assembly of the firearms carrying device of FIG. 1.

FIG. 2 is a front view of the base plate 10. In the current embodiment, the base plate 10 has a uniform-cross section consisting of a rigid sheet material. In the current embodiment, the base plate 10 is metal, such as aluminum. However, the base plate 10 can be any other rigid non-deforming material such as steel, titanium, various plasticized materials, various composite materials, etc. In the current embodiment, the base plate 10 is 1.6 mm (1/16") in thickness, and has overall rectangular dimensions approximately 76.2 mm×88.9 mm (3"×3½"), though the dimensions of the base plate 10 may be different in various embodiments and should not be considered limiting.

The base plate 10 has six slotted through-holes 12*a,b,c,d,e,f*, each approximately 28.5 Mm×3.2 mm (1⅛"×⅛") in dimension, though the dimensions of the slotted through-holes 12*a,b,c,d,e,f* may be different in various embodiments and should not be considered limiting. Two of the slotted through-holes 12*a,b* are oriented vertically—one on each side of the base plate 10. Four of the slotted through-holes 12*c,d,e,f* are oriented horizontally—two slotted through-holes 12*c,d* at the bottom of the base plate 10 and two slotted through-holes 12*e,f* near the top of the base plate 10.

The base plate 10 has one elongated slotted through-hole 14 located at the top of the plate. The elongated slotted through-hole 14 is oriented horizontally. The elongated slotted through-hole 14 is approximately 66.7 mm×3.2 mm (2⅝"×⅛") in dimension, though the dimensions of the elongated slotted through-hole 14 may be different in various embodiments and should not be considered limiting. The elongated slotted through-hole 14 is located above the two horizontal slotted through-holes 12*e,f* located near the top of the base plate 10.

The base plate 10 has four circular through-holes 16, though any number of circular through-holes 16 may be present in various embodiments. Two of the circular through-holes 16 are located on the sides of the upper half of the base plate 10. Two of the circular through-holes 16 are located near the bottom corners of the base plate 10. The circular through-holes 16 allow the fasteners 32 to connect the base plate 10 to the channel spacers 18,20 and the cover plate 22. The circular through-holes 16, slotted through-holes 12*a,b,c,d,e,f*, and elongated slotted through-hole 14 in the base plate 10 may be formed by machining or any other method.

FIG. 3 is a front view of the channel spacers 18,20. Channel spacer 18 and channel spacer 20 are mirror images of each other in the current embodiment. The channel spacers 18,20 fit between the cover plate 22 and the base plate 10. The channel spacers 18,20 have uniform cross sections formed of a rigid material. In the current embodiment, the channel spacers 18,20 are thermoplastic, such as Polyoxymethylene, also known as acetal. However, the channel spacers 18,20 may be formed of any other rigid material or combination of rigid materials, such as various polymeric and plastic materials, composites, metals, etc. The channel spacers 18,20 may be formed by machining, extruding, or molding.

The overall dimension of channel spacers 18,20 is approximately 21.4 mm×60.3 mm (27/32"×2⅜") each. The thickness of the channel spacers 18,20 is approximately 4.7 mm (3/16"). The shape of the channel spacers 18,20 can be roughly equated to an upside down "L" with angled outside corners that form angled ramps 33,34, though the channel spacers 18,20 may be other shapes in various embodiments. The angled ramps 33, 34 are approximately 49.9 degrees down from the top horizontal plane of the channel spacers 18,20. The inside distance between the vertical sides of the channel spacers 18,20 is approximately 33.3 mm (1 5/16"). The dimensions of the channel spacers 18,20 may be different in various embodiments and should not be considered limiting.

The outermost sides of the channel spacers 18,20 lie flush with the sides of the base plate 10, though the sides of the channel spacers 18,20 may not lie flush with the sides of the base plate 10 in various embodiments. Cutout portions 36,38 on the outside vertical portions of the channel spacers 18,20 lie flush with corresponding cutout portions 46,48 (shown in FIG. 4) on the cover plate 22. The cutout portions 36,38 of the channel spacers 18,20 and the cutout portions 46,48 of the cover plate 22 allow the vertical slotted through-holes 12*a,b* on the base plate 10 to be exposed. The angled ramps 33,34 of the channel spacers 18,20 may be formed by machining, extruding, or molding, or any other method. The cutout portions 36,38 on the channel spacers 18,20 may be formed by machining, extruding, or molding, or any other method.

In the current embodiment, the channel spacers 18,20 each have two circular through-holes 16. The circular through-holes 16 are located near the top and bottom of the channel spacers 18,20. The circular through-holes allow the fasteners 32 to pass through the channel spacers 18,20 thereby connecting the cover plate 22, channel spacers 18,20, and base plate 10 together. The circular through-holes 16 on the channel spacers 18,20 may be formed by machining, extruding, or molding, or any other method.

FIG. 4 is the front view of the cover plate 22. In the current embodiment, the cover plate 22 has uniform cross section consisting of a rigid sheet material. In the current embodiment, the cover plate is metal, such as aluminum. However, the cover plate can be formed of any other rigid non-deforming material such as steel, titanium, various plasticized materials, various composite materials, etc. In the current embodiment, the cover plate 22 is 1.6 mm (1/16") in thickness, and has overall dimensions approximately 60.3 mm×76.2 mm (2⅜"×3"), though the dimensions of the cover plate 22 may be different in various embodiments and should not be considered limiting. In the current embodiment, the shape of the cover plate 22 can be roughly equated to a "U". The long "U" shaped channel cutout 23 down the center of the cover plate 22 forms a channel with angled cuts at the top of the channel. The angled cuts form angled ramps 42,44 into the channel cutout 23. The angled ramps 42,44 are approximately 22.8 degrees down from the top horizontal plane of the cover plate 22. The length of the channel cutout 23 is approximately 54 mm (2⅛"), though the dimensions of the channel cutout 23 and the angled ramps 42,44 may be different in various embodiments and should not be considered limiting. In various embodiments, the angled ramps 42,44 may be straight, curved, or include multiple angled cuts. The bottom of the channel cutout 23 contains a radius cut 49 approximately 7.3 mm, though other dimensions may be present in various embodiment. The bottom of the cover plate 22 lies flush with the bottom of the channel spacers 18,20. The outermost sides of the cover plate 22 lie flush with the sides of the base plate 10 and the outermost sides of the channel spacers 18,20. The cutout portions 46,48 on the outside vertical portion of the cover plate 22 lies flush with the corresponding cutout portions 36,38 on the channel spacers 18,20. These cutout portions 46,48 allow the vertical slotted through-holes 12*a,b* on the base plate 10 to be exposed. The channel cutout 23 and corresponding radius cut 49 on the cover plate 22 may be formed by machining or any other method. The angled ramps 42,44 on the cover plate 22 may be formed by machining or any other method. The cutout portions 46,48 on the cover plate 22 may be formed by machining or any other method.

The cover plate 22 has four circular through-holes 16. The circular through-holes 16 are located near the corners of the cover plate 22. The circular through-holes 16 allow the fasteners 32 to pass from the cover plate 22 through the channel spacers 18,20 into the base plate 10 thereby connecting the cover plate 22, channel spacers 18,20, and base plate 10 together, forming the receiver assembly 110. All circular through-holes 16 in the cover plate 22 may be formed by machining or any other method.

Figure 6:
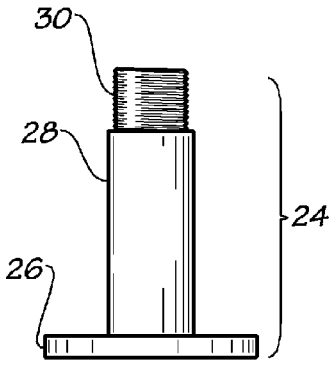
FIG. 6 is a side view of a slide link arm of the firearms carrying device of FIG. 1.

FIG. 6 shows a side view of the slide link arm 24. The slide link arm 24 is cylindrical in shape and rigid, though other shapes may be present in various embodiments. In the current embodiment, the slide link arm 24 is metal, such as aluminum, though other materials may be used in various embodiments. However, the slide link arm 24 can be formed of any other rigid non-deforming material such as steel, titanium, various plasticized materials, various composite materials, etc. The slide link arm 24 may be formed by machining or any other method.

In the current embodiment, the slide link arm 24 is one piece with three machined sections: slide link arm head 26, slide link arm shaft 28, and slide link arm sub-shaft 30. The slide link arm head 26 is approximately 31.7 mm (1¼") in diameter and 3.2 mm (⅛") in thickness. The slide link arm shaft 28 is approximately 12.7 mm (½") in diameter and 38.1 mm (1¼") in length. In various embodiments, the length of the slide link arm shaft 28 can be made with varying lengths depending on the distance desired between a firearm 90 (shown in FIG. 9) and the receiver assembly 110 while the firearm 90 is linked in a carry position. In the current embodiment, the slide link arm sub-shaft 30 is 6.4 mm (¼") to 12.7 mm (½") in diameter depending on the firearm 90 or firearm mount (not shown) to which it will be attached. In the current embodiment, the slide link arm sub-shaft 30 is 6.4 mm (¼") to 38.1 mm (1½") in length depending on the firearm 90 or firearm mount (not shown) to which it will be attached. Further, the dimensions of the slide link arm 24 may be different in various embodiments and should not be considered limiting. The slide link arm sub-shaft 30 can be attached to the firearm 90 or firearm mount by threads (internal or external), pin, etc. In the current embodiment, the slide link arm sub-shaft 30 is 9.5 mm (⅜") in length, 11.1 mm (7/16") in diameter, and 7/16-20 (UNF) externally threaded to mate to a modified Midwest Industries MCTAR-30HD firearm buffer tube sling mount 70 (shown in FIG. 9) for M16/AR-15/M4 type rifles with collapsible stocks or exposed buffer tubes. The slide link arm sub-shaft 30 is designed to be a removable, non-permanent part attached to the firearm 90 or firearm mount so that slide link arms 24 with different slide link shaft 28 lengths may be utilized.

Figure 7:
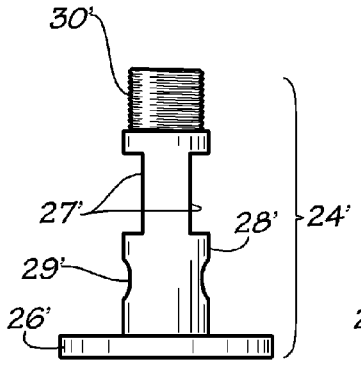
FIG. 7 is a side view of another embodiment of a slide link arm.
Figure 8:
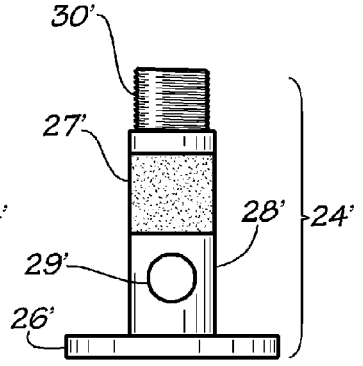
FIG. 8 is a another side view of the slide link arm of FIG. 7.

FIGS. 7 and 8 show a second embodiment of a slide link arm 24'. In the embodiment of FIGS. 7 and 8, the slide link arm 24' is one piece with five machined sections: slide link arm head 26', flat notches 27', slide link arm shaft 28', circular through-hole 29', and slide link arm sub-shaft 30'. Two flat notches 27' are located on opposite sides of each other on the slide link arm shaft 28' and are approximately 12.7 mm (½") in length and 3.2 mm (⅛") in depth. The centerline of the notches 27' is approximately 25.4 mm (1") from the base of the slide link arm head 26'. The circular through-hole 29' is approximately 5.6 mm (7/32") in diameter. The circular through-hole 29' is machined through the slide link arm shaft 28' approximately 12.7 mm (½") from the base of the slide link arm head 26'. Further, the dimensions of the slide link arm 24' may be different in various embodiments and should not be considered limiting.

In the current embodiment, the color or finish on all parts of the sling-less firearms carrying device 100 are black, subdued, matte, or blackened for hunting and tactical applications where reflection can be detrimental to the intent of the activity. The finish also provides a protective layer against rust or oxidation when non-stainless steel is used for the various components. However, the color and finish on the parts of the sling-less firearms carrying device 100 may be different in various embodiments and the disclosure of black, subdued, matte, or blackened finish should not be considered limiting.

The joined parts, the base plate 10, channel spacers 18,20, cover plate 22, and fasteners 32 are collectively known as the receiver assembly 110 or, alternatively, a carrier. The receiver assembly 110 is the portion of the sling-less firearms carrying device 100 that bears the weight of the firearm 90 being carried. The receiver assembly 110 "receives" the slide link arm 24. The weight of the firearm 90, when attached to the receiver assembly 110 via the slide link arm 24, is transferred through the slide link arm 24 into the receiver assembly 110, and from the receiver assembly 110 to the person's body (not shown). The term "person's body" includes any location to which the receiver assembly 110 can be attached including a utility vest 60 (shown in FIG. 9), belt, torso, etc. The receiver assembly 110 is attached about the person's body through various ways including, but not limited to, straps, harness, rope, cord, MOLLE (Modular Lightweight Load-carrying Equipment) or PALS (Pouch Attachment Ladder System) connectors, and webbing. The base plate 10 of the receiver assembly 110 contains six slotted through-holes 12*a,b,c,d,e,f* and one elongated slotted through-hole 14 through which straps, webbing, etc. of various sizes can be attached, passed through, or interwoven to attach the receiver assembly about the person's body.

Figure 9:
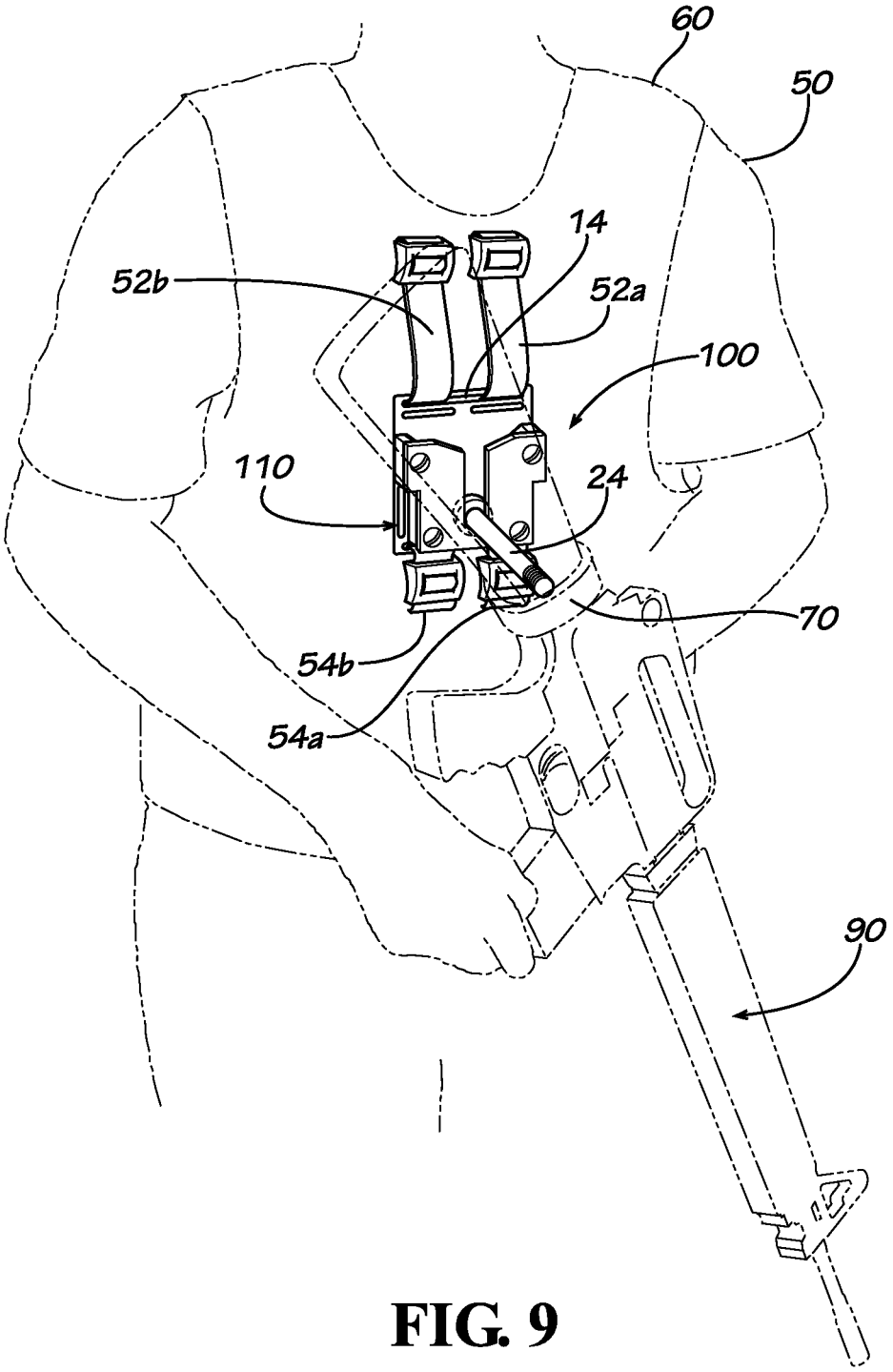
FIG. 9 is a perspective view of the firearms carrying device of FIG. 1 strapped to a utility vest worn on a user, the firearms carrying device shown linking a rifle in a carrying position.

FIG. 9 shows one embodiment of the firearms carrying device 100 linking a firearm 90 to a user 50. In the current embodiment, the user 50 is wearing a utility vest 60. The receiver assembly 110 is connected to the utility vest 60 by upper straps 52*a,b* and lower straps 54*a,b*. Upper straps 52*a,b* are connected to the receiver assembly 110 via elongated slotted through-hole 14 and lower straps 54*a,b* are connected to the receiver assembly 110 via slotted through-holes 12*c,d*, respectively. In the current embodiment, the upper straps 52*a,b* and the lower straps 54*a,b* are TacTie Attachment Straps sold by Maxpedition.com, though the upper straps

52*a,b* and the lower straps 54*a,b* may be any type of strap in various embodiments, and the disclosure of TacTie Attachment Straps should not be considered limiting. Slide link arm 24 is connected to the firearm 90 via a buffer tube sling mount 70 attached to the firearm 90.

Figure 10A:
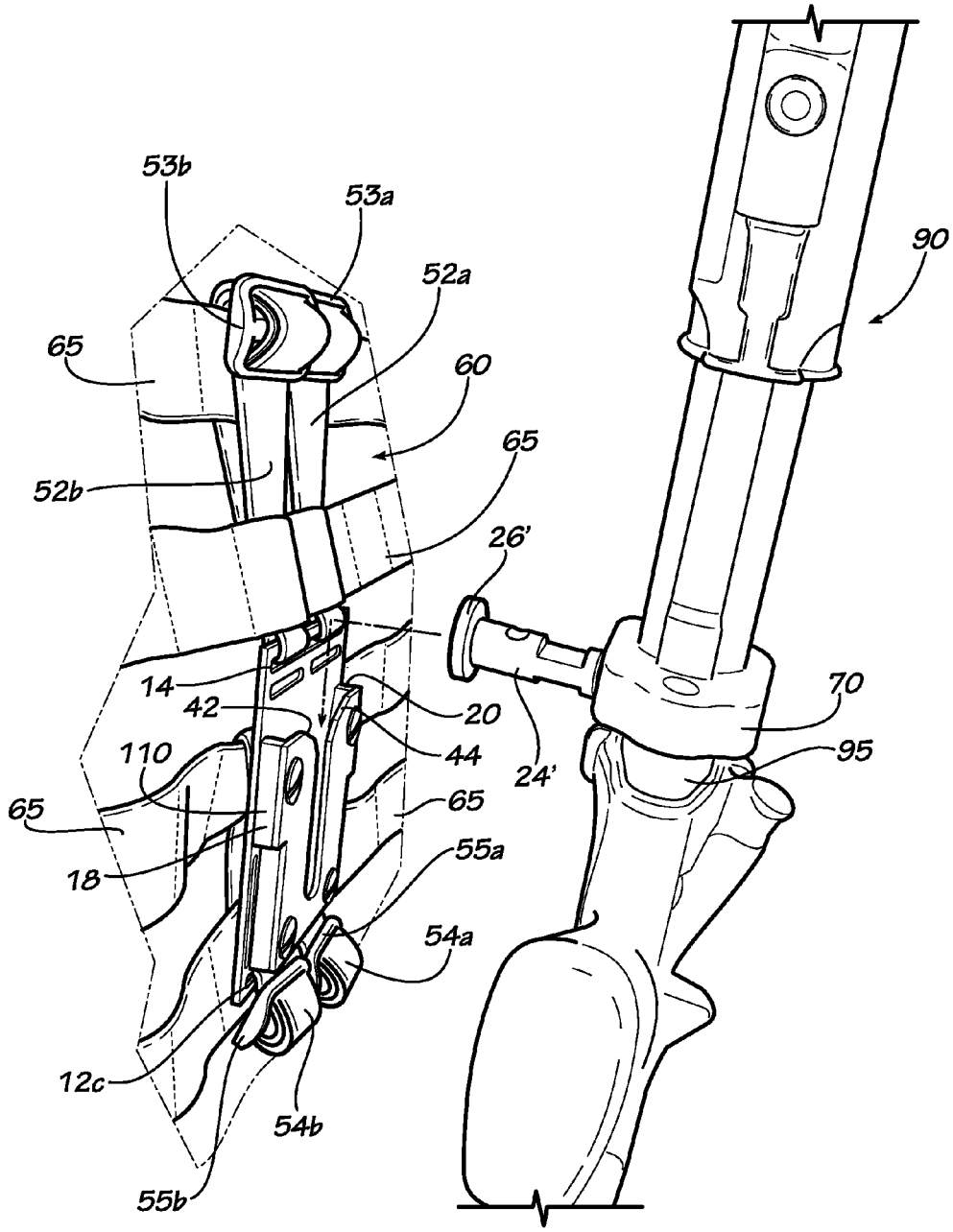
FIG. 10A is a perspective view of the firearms carrying device of FIG. 1 prior to linking the rifle to the utility vest.
Figure 10B:
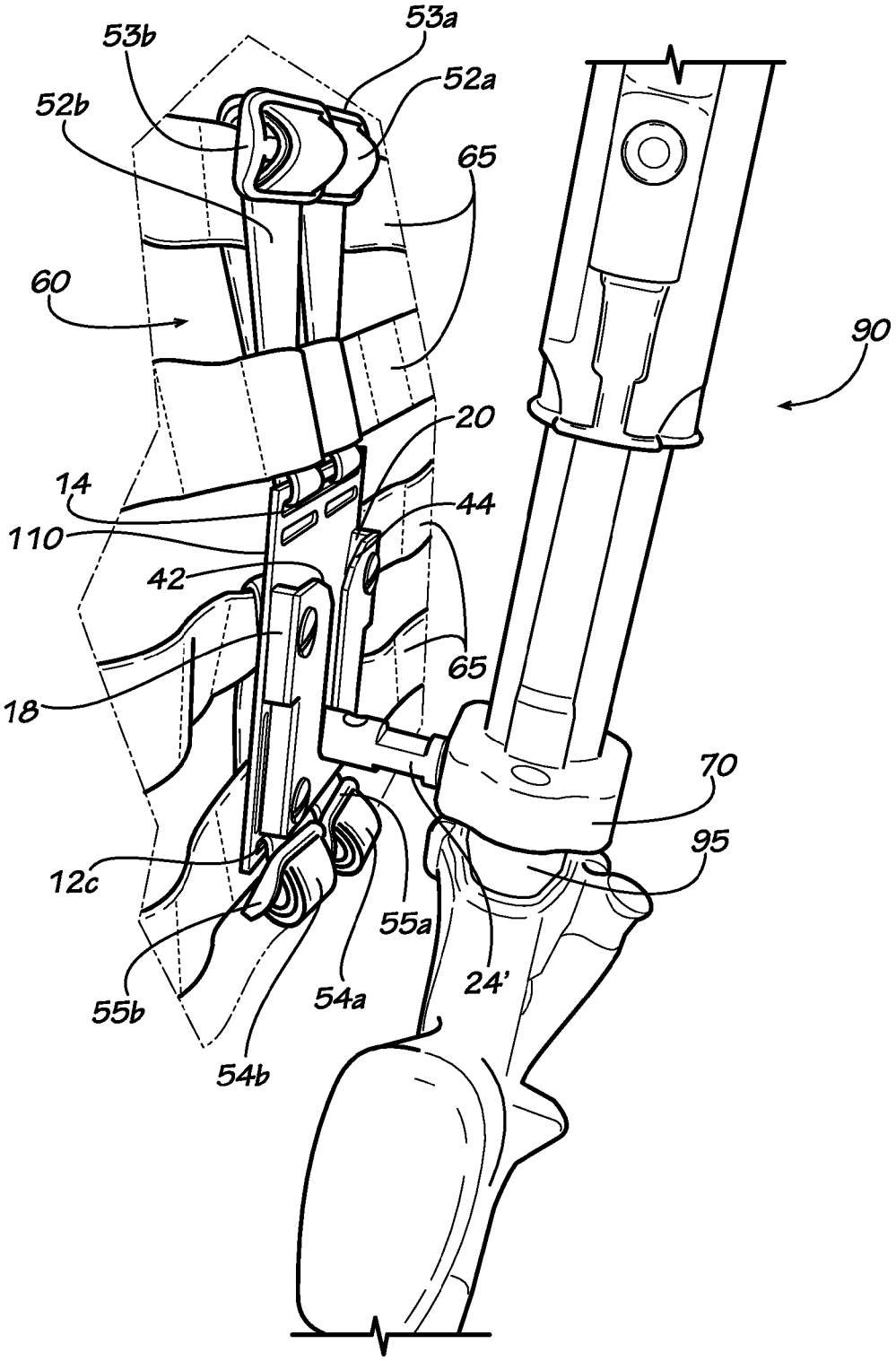
FIG. 10B is a perspective view of the firearms carrying device of FIG. 1 after linking the rifle to the utility vest.

FIGS. 10A and 10B show a close-up of the firearm 90 linked to the utility vest 60. In the embodiment of FIGS. 10A and 10B, the slide link arm 24 has been replaced by slide link arm 24', though the interaction of receiver assembly 110 and slide link arm 24 is similar to the interaction of receiver assembly 110 and slide link arm 24' as shown in FIGS. 10A and 10B. In the current embodiment, the buffer tube sling mount 70 is attached to the firearm 90 at an exposed buffer tube 95 of the firearm 90. Also shown in FIGS. 10A and 10B are the connections between the upper straps 52*a,b* and the utility vest 60 and connections between the lower straps 54*a,b* and the utility vest 60. In the current embodiment, utility vest 60 includes a plurality of horizontal connecting straps 65. Upper straps 52*a,b* and lower straps 54*a,b* wrap around the connecting straps 65 and are tightened with buckles 53*a,b* and 55*a,b*, respectively.

As seen in FIGS. 10A and 10B, the channel spacers 18,20 help guide and contain the slide link arm head 26' as the slide link arm head 26' enters into the top and rests inside the receiver assembly 110. The angled ramps 33,34 at the top portion of the channel spacers 18,20 guide the slide link arm head 26' into the vertical space between the channel spacers 18,20. The open space between the channel spacers 18,20 keeps debris from accumulating in the receiver assembly 110, thus allowing debris to pass through and out the bottom of the receiver assembly 110. In the current embodiment, the channel spacers 18,20 are constructed from a polymer material, though the disclosure of polymer material channel spacers 18,20 should not be considered limiting. Polymer channel spacers 18,20 reduce the weight of the receiver assembly 110 (as opposed to metal spacers). Polymer channel spacers 18,20 help to absorb potential noise produced when the slide link arm head 26' enters and exits the receiver assembly 110. Metal spacers may tend to reflect noise. The use of polymer generally reduces the overall cost of the sling-less firearms carrying device 100. However, different materials may be used in various embodiments, and the current disclosure of polymer materials should not be considered limiting.

The angled ramps 42,44 at the top of the cover plate 22 guide and align the slide link shaft 28' into the channel cutout 23 of the cover plate 22. The angled ramps 42,44 on the cover plate 22 guide and align the slide link shaft 28' in the same manner as the angled ramps 33,34 portion of the channel spacers 18,20 guide and align the slide link arm head 26'. This dual ramping design allows greater ease and control of the slide link 24' as it enters into the receiver assembly 110. The long "U" shaped channel cutout 23 on the cover plate 22 guides and contains the slide link arm shaft 28' as it slides into and out of the main body of the receiver assembly 110. The bottom portion of the long "u" shaped channel cutout 23 supports and holds the slide link arm shaft 28' once it is fully inserted into the receiver assembly 110. The cover plate 22 keeps the slide link arm head 26' from tipping or falling out of the receiver assembly. The slide link arm head 26' rests in-between the channel spacers 18,20 (side to side) and space created by the channel spacers 18,20 between the base plate 10 and the cover plate 22 (front to back). The long "U" shaped channel cutout 23 on the cover plate 22 provides enough depth to keep the firearm 90 from bouncing out of the receiver assembly 110 during rigorous movement, but is not so deep as to prevent rapid extraction of the firearm 90 from the receiver assembly 110.

As shown in FIGS. 10A and 10B, the slide link arm 24' may attach perpendicularly to the right or left side of the firearm 90 depending on the preference of the user 50. The slide link arm 24' "links" the firearm 90 to the receiver assembly 110'. The firearm 90 is linked to the receiver assembly 110 when the slide link arm head 26' enters into the channel between the channel spacers 18,20, and the slide link arm shaft 28' slides into the long "U" shaped channel cutout 23 of the cover plate 22. The slide link arm 24' is attached to the firearm 90 via the slide link arm sub-shaft 30'. The slide link arm sub-shaft 30' can be attached to the firearm 90 or firearm mounts by threads (internal or external), pin, etc. In the current embodiment, the slide link arm sub-shaft 30' screws into a modified sling mount such as buffer tube sling mount 70, which is a Midwest Industries MCTAR-30HD firearm buffer tube sling mount for M16/AR-15/M4 type rifles with collapsible stocks or exposed buffer tubes such as buffer tube 95. The MCTAR-30HD has 9.5 mm (⅜") diameter holes with an equal depth on the left and right sides of the mount. The MCTAR-30HD holes are modified through tapping and threading to accept the slide link arm sub-shaft 30'. The flat notches 27' and circular through-hole 29' provide two features that may assist screwing and tightening the slide link arm 24' into a mount. The flat notches 27' may accommodate the use of a wrench, pliers, or similar tool to screw-in and tighten the slide link arm 24' into a mount. The circular through-hole 29' accommodates the use of a screw driver, M16/AR-15/M4 cleaning rod, or similar tool to screw-in and tighten the slide link arm 24' into a mount. The machined away portions of the slide link arm 24' forming the flat notches 27' and circular through-hole 29' also act as lightening measures to reduce the weight of the slide link arm 24'.

In the current embodiment, the placement of the slide link arm 24' behind the center of gravity of the firearm 90, as it would be when attached to the buffer tube 95, keeps the muzzle end of the firearm 90 pointed safely down towards the ground while in the carry position. The weight of the firearm 90 helps to securely hold the slide link arm 24' inside the receiver assembly 110, because the weight of the firearm 90 is below the attachment point on the firearm 90 of the slide link arm 24'. In the current embodiment, the slide link arm sub-shaft 30' is a removable, non-permanent part attached to the firearm 90 or firearm mount so that slide link arms 24' with different slide link arm shafts 28' may be utilized.

As shown in FIGS. 10A and 10B, in the current embodiment, the slide link arm 24' is simply placed into or removed from the top of the receiver assembly 110 by a vertical movement up or down. The circular design of the slide link arm head 26' and shaft 28' in the current embodiment allows the firearm 90 to be removed from the receiver assembly 110 regardless of the attitude of the firearm 90 relative to the 360 degree plane around the slide link arm 24'. In other words, the slide link arm 24' will not bind the firearm 90 inside the receiver assembly 110 as long as the firearm 90 itself may be moved along the distance of the channel cutout 23 on the cover plate 22.

The receiver assembly 110 is not limited to mounting just about a person's body. The receiver assembly 110 may also be attached to objects such as a backpack, vehicle, saddle, etc. There are various ways to mount the receiver assembly 110 to objects. The use of hook and loop closures, magnets, adhesives, screws, rivets, bolts etc. may be attached to or added to the base plate 10 to facilitate attachments to objects. The base plate 10 can be modified or altered to accommodate the object to which it will be attached. In various embodiments, slotted through-holes 12,14 may be replaced with circular or square holes to facilitate screws or bolts for attaching the receiver assembly 110 to an object. Similarly, the slotted through-holes 12,14 may be replaced with circular or square holes to accommodate rope or chord with larger diameters. In various embodiments, elongated slotted through-hole 14 may be replaced with two additional slotted through-holes 12.

The slotted through-holes 12*a,b* on the side of the base plate 10 may be lengthened to 38.1 mm (1½") and/or widened to accommodate larger straps, webbing, cord, etc in various embodiments. The slotted through-holes 12*e,f* on the top of the base plate 10 may be joined to form one long slotted through hole with the same linear dimension as the elongated slotted through-hole 14 to accommodate wider straps, or any other dimension in various embodiments. Likewise, the slotted through holes 12*c,d* on the bottom of the base plate 10 may be joined to form one long slotted through hole.

The separate components of the receiver assembly 110 could be collectively lengthened or shortened, thickened or reduced, and/or narrowed or widened to accommodate the strategic intentions of the user 50, the weight of the firearm 90, and the means by which the receiver assembly 110 is to be attached to the carrier. In the current embodiment, the design of the receiver assembly 110 balances both secure carry and rapid extraction of the firearm 90, though other designs may provide the same balance in various embodiments. However, if, in various embodiments, retention of the firearm 90 in the carried position is of higher importance than rapid extraction for a particular user 50, the length of the receiver assembly 110 could be increased so the slide link arm 24 has a greater distance to travel out of the long "U" shaped channel cutout 23. Dimensions for the circular through-holes 16 and fasteners 32 could similarly be adjusted to accommodate changes in the receiver assembly 110.

In various embodiments, the channel spacers 18,20, cover plate 22, or base plate 10 could be functionally combined, in any combination, by machining, stamping, extruding, or molding, among other methods, to form one solid, three dimensional piece of metal, composite, or polymer that would replace the separate parts (not shown).

The length of the slide link shaft 28 of the slide link arm 24 can be fabricated to varying lengths. The option to choose slide link arms 24 with different shaft lengths allows greater versatility for the user 50. In various embodiments, if a person is wearing a vest with pouches that extend out 50.8 mm (2"), a shaft length of 63.5 mm (2½") may be used so that the firearm 90 rests on the outside of the pouches while carried in the receiver assembly 110.

In the current embodiment, the sling-less firearms carrying device 100 mitigates lateral movement of the firearm 90 when the firearm 90 is linked to the receiver assembly 110. The use of a keeper device (not shown) may be used in conjunction with the sling-less firearms carrying device 100 to further mitigate lateral movement of the firearm 90 while linked into the receiver assembly 110. In various embodiments, a keeper device in the shape of a "u" or "j" hook could be attached to a MOLLE vest. The barrel or forearm portion of the firearm 90 could rest inside or hook onto such a keeper while the firearm 90 is linked into the receiver assembly 110, thereby preventing lateral movement.

There are various possibilities with regard to mounting the slide link arm 24 to firearms 90. The firearm 90 may be any rifle, machinegun, sub-machine, shotgun, and even pistol. The firearm 90 may be modified to accept the slide link arm sub-shaft 30. The diameter, length, and attachment method (e.g. internally threaded, externally threaded, link pin, etc.) of the slide link arm sub-shaft 30 may be modified as well to accommodate various mounting methods. In the current embodiment, the slide link arm 24 is attached to the buffer tube 95 of an expandable butt stock via a modified buffer tube sling mount 70 (produced by several manufacturers). Other mounting methods include, but are not limited to, the following: tapping and threading the side or butt stock of a firearm 90 to accommodate the slide link arm sub-shaft 30; welding or bonding a nut to the side of a firearm 90 or firearm butt stock with internal dimensions and threading to accommodate the slide link arm sub-shaft 30; lengthening the slide link arm sub-shaft 30 to replace a pin on the firearm 90, such as replacing the take down pin on an M16/M4/AR-15; lengthening and threading the take down pin on an M16/M4/AR-15 to receive an internally threaded slide link arm 24; redesigning and manufacturing firearms 90 to incorporate the slide link arm 24.

In the current embodiment, the slide link arm 24 is removable from the firearm 90. In various embodiments, the slide link arm 24 would be permanently attached to a firearm 90. In various embodiments, the slide link arm 24 could be welded to the side of a firearm 90.

Though one potential benefit of the sling-less firearms carrying device 100 is rapid extraction of a firearm 90 from the carrier (receiver assembly 110), a retention mechanism could be fabricated into or attached to the receiver assembly 110 to selectively hold the slide link arm 24 inside the receiver assembly 110. Such an option would, in various embodiments, allow a firearm 90 to be safely carried when the person or object is placed in an unusual attitude (e.g. upside down) or when retention of the firearm 90 in the receiver assembly 110 is desired.

The sling-less firearms carrying device 100 can be finished using different colors or even polished. In the current embodiment, the finish on the receiver assembly 110 is subdued to prevent reflection. In various embodiments, finishes (or partial finishes) may include highly polishing the back of the base plate 10 when the base plate 10 is comprised of stainless steel or aluminum. A highly polished base plate 10 allows the receiver assembly 110 to be used as a reflective signaling device in the event of an emergency or for communication.

The sling-less firearms carrying device 100 is highly flexible to accommodate different firearms 90 and carrying methods without binding the firearm 90 about a person's body, as is the case with sling designs.

One should note that conditional language, such as, among others, "can," "could," "might," or "may," unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more particular embodiments or that one or more particular embodiments necessarily include logic for deciding, with or without user input or prompting, whether these features, elements and/or steps are included or are to be performed in any particular embodiment.

It should be emphasized that the above-described embodiments are merely possible examples of implementations, merely set forth for a clear understanding of the principles of the present disclosure. Any process descriptions or blocks in flow diagrams should be understood as representing modules, segments, or portions of code which include one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described embodiment(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A firearms carrying device comprising:

a receiver assembly including a base plate and a cover plate connected to the base plate, the receiver assembly having a top and a bottom, the cover plate defining a channel cutout, an open top end of the channel cutout defined along a top edge of the cover plate, the top edge of the cover plate offset vertically from a top edge of the base plate when the receiver assembly is in an upright position so that the top edge of the cover plate is lower than the top edge of the base plate, the base plate having a continuous planar front surface facing towards the cover plate and extending upward past the top edge of the cover plate and downward to at least to a bottom edge of the cover plate distal from the top edge, the front surface of the base plate and the channel cutout of the cover plate defining a channel, the front surface thereby defining a channel bottom of the channel, the channel bottom extending from the top edge of the cover plate to a lower edge of the channel cutout distal from the top edge; and a link arm linkable with the receiver assembly, the link arm mountable on a firearm, the receiver assembly configured to bear the weight of the firearm when the top of the receiver assembly is positioned higher than the bottom of the receiver assembly, the link arm slidable within the channel cutout.

2. The firearms carrying device of claim 1, wherein the channel cutout forms at least one angled ramp.

3. The firearms carrying device of claim 1, wherein the receiver assembly further includes at least one channel spacer between the cover plate and the base plate, the at least one channel spacer further defining the channel.

4. The firearms carrying device of claim 3, wherein each at least one channel spacer defines an angled ramp.

5. The firearms carrying device of claim 3, wherein the at least one channel spacer is two channel spacers.

6. The firearms carrying device of claim 1, wherein the base plate includes at least one horizontal slotted through-hole.

7. The firearms carrying device of claim 6, wherein the at least one horizontal slotted through-hole includes two horizontal slotted through-holes proximate the top edge of the base plate and two horizontal slotted through-holes proximate a bottom edge of the base plate.

8. The firearms carrying device of claim 1, wherein the base plate and the cover plate are connected by at least one fastener.

9. The firearms carrying device of claim 1, wherein the link arm includes a head.

10. The firearms carrying device of claim 1, wherein the link arm includes a threaded sub-shaft.

11. The firearms carrying device of claim 1, wherein the base plate and the cover plate are flat plates positioned substantially parallel to each other.

12. A firearms carrying system comprising:

a firearm, the firearm including a buffer tube sling mount, the buffer tube sling mount having a mount body sized to wrap around a buffer tube of a rifle and defining a link arm mounting bore, the link arm mounting bore including internal threading;

a receiver assembly including a base plate that is flat and a cover plate that is flat and connected to the base plate, the receiver assembly having a top and a bottom, the receiver assembly further including two channel spacers between the cover plate and the base plate, the cover plate defining a channel cutout, an open top end of the channel cutout defined along a top edge of the cover plate, the base plate defining two horizontal slotted through-holes proximate the top of the receiver assembly, the base plate defining two horizontal slotted through-holes proximate the bottom of the receiver assembly, the base plate defining a first vertical slotted through-hole proximate a first edge of the base plate defined between the top and the bottom of the receiver assembly, the base plate defining a second vertical slotted through-hole proximate a second edge of the base plate distal from the first edge and defined between the top and the bottom of the receiver assembly, each of the two channel spacers defining an angled ramp at a top inside edge of each of the two channel spacers, the channel cutout forming two angled ramps, the angled ramps of the channel spacers having a steeper angle than the angled ramps of the channel cutout, the top edge of the cover plate offset vertically from a top edge of the base plate when the receiver assembly is in an upright position so that the top edge of the cover plate is lower than the top edge of the base plate, a bottom edge of the cover plate offset vertically from a bottom edge of the base plate when the receiver assembly is in an upright position so that the bottom edge of the cover plate is higher than the bottom edge of the base plate, the base plate having a continuous planar front surface facing towards the cover plate and extending upward past the top edge of the cover plate and downward to at least a bottom edge of the cover plate distal from the top edge, the front surface of the base plate, the channel cutout of the cover plate, and the channel spacers defining a channel, the front surface thereby defining a channel bottom of the channel, the channel bottom extending from the top edge of the cover plate to a lower edge of the channel cutout distal from the top edge; and a link arm linkable with the receiver assembly, the link arm including a link arm head, a link arm shaft, and a threaded sub-shaft, the link arm attached to the buffer tube sling mount of the firearm by the threaded sub-shaft engaging the link arm mounting bore, a thickness of the link arm head being less than a shortest distance between the base plate and the cover plate, a distance equaling a length of the link arm shaft being greater than a distance equaling a diameter of the link arm shaft, the receiver assembly adapted to bear the weight of the firearm when mounted on a substantially vertical surface, the link arm slidable within the channel cutout, the open top end of the channel cutout sized to receive the link arm at the top of the receiver assembly, the front surface of the base plate defining a stop by which to guide the link arm head into the channel.

13. The firearms carrying system of claim 12, wherein:

a first channel spacer of the two channel spacers defines a first spacer cutout portion, a second channel spacer of the two channel spacers defines a second spacer cutout portion, and the cover plate defines a first plate cutout portion and a second plate cutout portion distal from the first plate cutout portion;

the first spacer cutout portion and the first plate cutout portion expose the first vertical slotted through-hole when the first spacer and the cover plate are connected to the base plate; and the second spacer cutout portion and the second plate cutout portion expose the second vertical slotted through-hole when the second spacer and the cover plate are connected to the base plate.

14. The firearms carrying system of claim 12 further comprising a first strap, a second strap, a third strap, and a fourth strap for securing the receiver assembly to a person's body, the first strap secured to a first of the two horizontal slotted through-holes proximate the top edge of the base plate;

the second strap secured to a second of the two horizontal slotted through-holes proximate the top edge of the base plate;

the third strap secured to a first of the two horizontal slotted through-holes proximate the bottom edge of the base plate; and the fourth strap secured to a second of the two horizontal slotted through-holes proximate the bottom edge of the base plate.

15. A method of using a firearms carrying device comprising:

connecting a receiver assembly to a user, the receiver assembly including a base plate connected to a cover plate, a top edge of the cover plate offset vertically from a top edge of the base plate when the receiver assembly is in an upright position so that the top edge of the cover plate is offset vertically from a top edge of the base plate when the receiver assembly is in an upright position so that the top edge of the cover plate is lower than the top edge of the base plate, the base plate having a continuous planar front surface facing towards the cover plate and extending upward past the top edge of the cover plate and downward to at least a bottom edge of the cover plate distal from the top edge, the front surface of the base plate and the channel cutout of the cover plate defining a channel, the front surface thereby defining a channel bottom of the channel, the channel bottom extending from the top edge of the cover plate to a lower edge of the channel cutout distal from the top edge;

mounting a link arm to a firearm, the link arm having a link arm head; and linking the link arm to the receiver assembly by bringing the link arm head of the link arm into facing contact with the front surface of the base plate above the top edge of the cover plate and sliding the link arm head along the front surface downward into the channel cutout so that the link arm head contacts the front surface and is positioned between the cover plate and the base plate, the receiver assembly configured to bear the weight of the firearm to enable the user to remove both hands from the firearm.

16. The method of claim 15, wherein connecting the receiver assembly to the user includes tightening at least one strap through at least one horizontal slotted through-hole defined in the receiver assembly.

17. The method of claim 16, wherein the at least one slotted through-hole is defined in the base plate of the receiver assembly.

18. The method of claim 15, wherein the channel cutout forms at least one angled ramp.

19. The method of claim 18, wherein the link arm includes a shaft defining a pair of flat notches and a circular through-hole.

20. The method of claim 15, wherein linking the link arm to the receiver assembly includes the receiver assembly bearing the weight of the firearm, the method further comprising removing the firearm by a vertical upward movement out of the receiver assembly.

* * * * *